US008406429B2

(12) United States Patent
Kim et al.

(10) Patent No.: US 8,406,429 B2
(45) Date of Patent: Mar. 26, 2013

(54) SOUND SEPARATING APPARATUS

(75) Inventors: Dae-Woo Kim, Yangcheon-gu (KR); Ho-Jun Park, Songpa-gu (KR); Hyun-Moo Jung, Seongnam-si (KR)

(73) Assignee: Expamedia, Inc., Seoul (KR)

( * ) Notice: Subject to any disclaimer, the term of this patent is extended or adjusted under 35 U.S.C. 154(b) by 1083 days.

(21) Appl. No.: 12/252,757

(22) Filed: Oct. 16, 2008

(65) Prior Publication Data

US 2009/0122995 A1 May 14, 2009

(30) Foreign Application Priority Data

Nov. 8, 2007 (KR) ..... 10-2007-0113585

(51) Int. Cl.
*H04R 5/00* (2006.01)

(52) U.S. Cl. ..... 381/17; 381/18; 381/23; 704/200.1

(58) Field of Classification Search ..... 381/17, 381/18, 23; 704/200.1
See application file for complete search history.

(56) References Cited

U.S. PATENT DOCUMENTS

2005/0135629 A1* 6/2005 Kim et al. ..... 381/17
2007/0195964 A1* 8/2007 Yokota ..... 381/26
2009/0264114 A1* 10/2009 Virolainen et al. ..... 455/416

FOREIGN PATENT DOCUMENTS

KR 10-1998-031979 7/1998
KR 10-2005-0064442 6/2005

* cited by examiner

*Primary Examiner* — Lynne Gurley
*Assistant Examiner* — Vernon P Webb
(74) *Attorney, Agent, or Firm* — Sherr & Jiang, PLLC

(57) ABSTRACT

An apparatus for spatially separating sounds from at least two sound sources includes a sound detection unit and a sound control unit. The sound detection unit detects a first sound from a first sound source while a second sound is outputted from a second sound source. The sound control unit performs a head-related transfer function (HRTF) on the second sound to move the second sound to a user's desired position according to the detection result, thereby the second sound is set as a background sound.

6 Claims, 9 Drawing Sheets

SOUND SEPARATING APPARATUS

CROSS-REFERENCE TO RELATED APPLICATION

This application claims the benefit of Korean Patent Application No. 2007-113585, filed Nov. 8, 2007, the contents of which are hereby incorporated herein by reference in their entirety.

BACKGROUND

1. Technical Field

This application relates to a sound separating apparatus.

2. Description of Related Art

A sound playing device is used by various applications for music listening, language study, etc. The sound playing device can play sounds from two or more sound sources at the same time or play sound selected from the two or more sound sources.

When a user wants to listen to first sound from one sound source while listening to second sound from another sound source, the user stops, pauses or mutes the second sound and then listens to the first sound.

For example, when a cellular phone rings while its user is listening to music on the cellular phone, the user can answer the phone after stopping or pausing the music. For another example, when a cellular phone rings while its user is watching television, the user can answer the phone after turning off or muting the television. For still another example, when a cellular phone rings while its user is listening to music in a car, the user can answer the phone after muting the music. Therefore, the user's listening may be interrupted.

SUMMARY

In some embodiments, an apparatus for spatially separating sounds from at least two sound sources includes a sound detection unit and a sound control unit. The sound detection unit detects a first sound from a first sound source while a second sound is outputted from a second sound source. The sound control unit performs a head-related transfer function (HRTF) on the second sound to move the second sound to a user's desired position according to the detection result, thereby the second sound is set as a background sound.

The sound control unit may control a volume of the second sound before or after moving the second sound.

The sound control unit may perform a HRTF on the first sound to move the first sound to another user's desired position, thereby the user can clearly hear the first sound. The sound control unit may control a volume of the first sound before or after moving the first sound.

In one embodiment, the apparatus may include a cellular phone supporting a music player function. In another embodiment, the apparatus may include a digital television set supporting a picture-in-picture (PIP) function.

The user's desired position may be set by the user or automatically set such that the second sound can be clearly heard.

The apparatus may further include a mixer configured to mix the moved first sound and the second sound.

In some embodiments, a system for spatially separating sounds output from at least two sound sources includes a first apparatus configured to generate a control signal when a first sound is output from a first sound source, and a second apparatus including a head-related transfer function (HRTF)/Volume control unit configured to perform an HRTF on the second sound source based on the generated control signal to move a second sound generated by a second sound source to a user's desired position, thereby the second apparatus set the second sound as a background sound.

The HRTF/volume control unit may control a volume of the second sound before or after moving the second sound.

The first apparatus may perform the HRTF on the first sound and moves the first sound to another user's desired position such that the user can clearly hear the first sound. The first apparatus may control a volume of the first sound before or after generating the first sound.

The first apparatus may include a telephone and the second apparatus may include an apparatus capable of outputting a sound.

The user's desired position may be set by the user or automatically set such that the second sound can be clearly heard.

In some embodiments, a method of spatially separating sounds output from at least two sound sources includes detecting a second sound outputted from a second sound source while a first sound is output from a first sound source, and performing a head-related transfer function (HRTF) on the first sound to move the first sound to a user's desired position according to the detection result, thereby the first sound is set as a background sound.

In some embodiments, a method of spatially separating sounds output from at least two sound sources includes, under the control of a first apparatus, generating a control signal when a first sound is output from a first sound source, and under the control of a second apparatus, performing a head-related transfer function (HRTF) on the second sound source based on the generated control signal to move a second sound generated by a second sound source to a user's desired position, thereby the first sound is set as a background sound.

DETAILED DESCRIPTION

The technology is described more fully hereinafter with reference to the accompanying drawings, in which example embodiments of the technology are illustrated. The technology may, however, be embodied in many different forms and should not be construed as limited to the example embodiments set forth herein. Rather, these example embodiments are provided to fully enable those of ordinary skill in the art to embody and practice the technology.

Terms used herein are to be understood as described below.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element.

The term "and/or" includes any and all combinations of one or more of the associated listed items. For example, "a first item, a second item and/or a third item" denotes at least one of the first item, the second item and the third item, that is, all the combinations of the first, second and third items including the first item, the second item and the third item each.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements, e.g., "between" versus "directly between" and "adjacent" versus "directly adjacent", should be interpreted in a like fashion.

As used herein, the singular forms "a", "an" and "the" are intended to include the plural forms as well, unless the context clearly indicates otherwise. It will be further understood that the terms "comprises", "comprising", "includes" and/or "including" when used herein, specify the presence of stated features, integers, steps, operations, elements and/or components, but do not preclude the presence or addition of one or more other features, integers, steps, operations, elements, components and/or groups thereof.

Respective steps described herein may be performed in a different order than that which is explicitly described. In other words, the respective steps may be performed in the same order as described, simultaneously, or in a reverse order.

Unless defined otherwise, all terms used herein have the same meaning as commonly understood by those of skill in the art. Such terms as those defined in a generally used dictionary are to be interpreted to have the meanings equal to the contextual meanings in the relevant field of art, and are not to be interpreted to have ideal or excessively formal meanings unless clearly defined in the present specification.

Figure 1A:
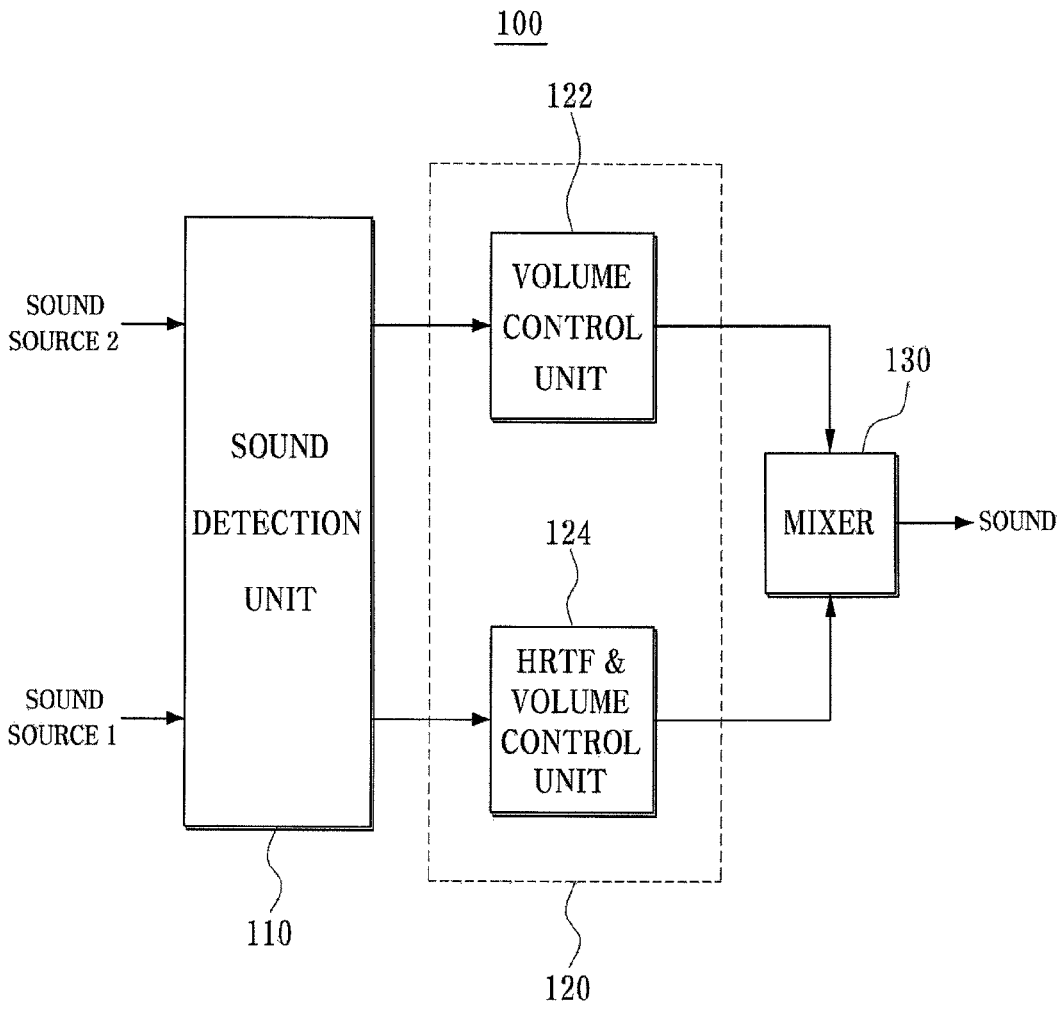
FIGS. 1A and 1B are block diagrams illustrating a sound separating apparatus according to an example embodiment of the described technology.
Figure 1B:
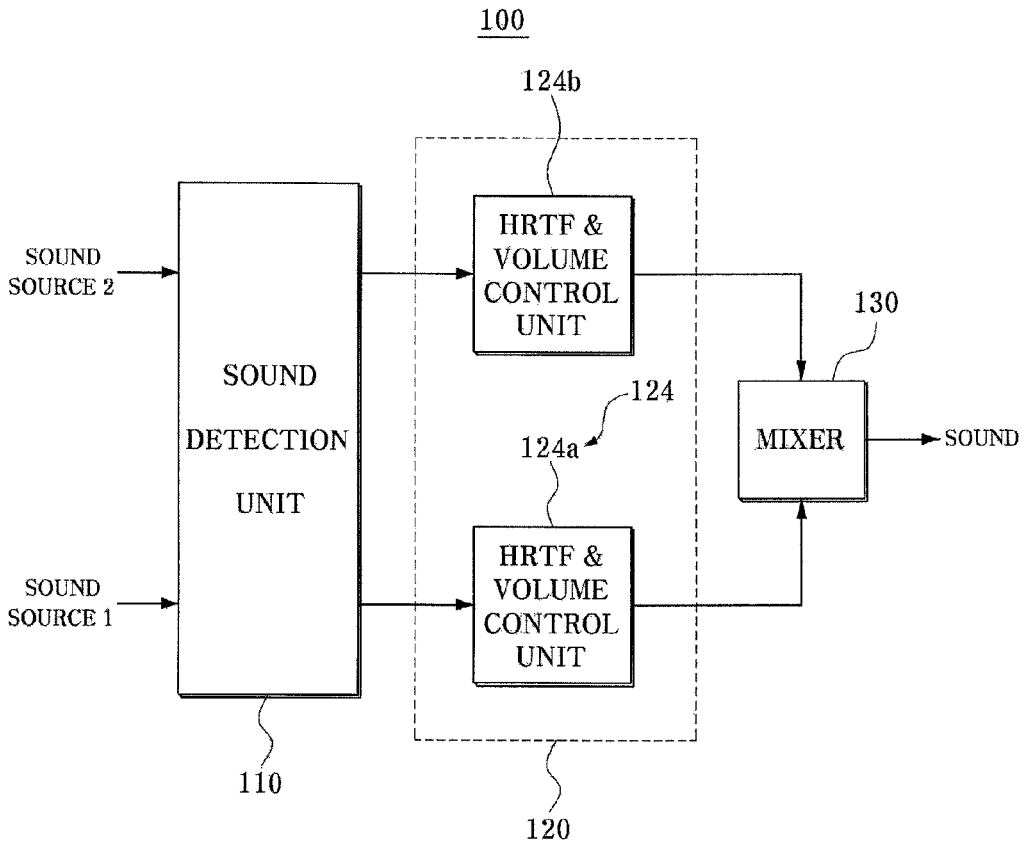

FIGS. 1A and 1B are block diagrams illustrating a sound separating apparatus according to an example embodiment of the described technology.

Referring to FIGS. 1A and 1B, a sound separating apparatus 100 includes a sound detection unit 110, a sound control unit 120 and a mixer 130.

When a second sound is output from a second sound source while a first sound is output from a first sound source, the apparatus 100 performs a head-related transfer function (HRTF) on the first sound to move the first sound to a user's desired position. As a result, the apparatus 100 can separate the first and second sounds in space and can set the first sound as a background sound.

The HRTF denotes an impulse response obtained from an apparatus artificially implementing an environment in consideration of physical characteristics of a human auditory system. In one embodiment, the user's desired position may be set by the user. In another embodiment, it may be automatically set such that the first sound can be clearly heard.

For example, the apparatus 100 may correspond to a cellular phone. When the user answers the cellular phone, e.g., by pushing a call button, while listening to music on the cellular phone, the HRTF may be performed on the music to move the sound of the cellular phone call to a user's desired position, e.g., a position where the sound of the cellular phone call is most clearly heard.

For another example, the apparatus 100 may correspond to a digital television set supporting a picture-in-picture (PIP) function. When the user turns on the PIP function, the HRTF may be performed on a sound on the sub-screen to move the sound on the sub-screen to a user's desired position, e.g., a position where a sound on a main screen is most clearly heard.

The apparatus 100 will be described in detail below with reference to FIGS. 1A and 1B.

The sound detection unit 110 detects the second sound while the first sound is output. For example, when the apparatus 100 corresponds to a cellular phone, the sound detection unit 110 can detect that the cellular phone rings while music is being played.

In one embodiment, the sound control unit 120 may include a volume control unit 122 and an HRTF/Volume control unit 124, as illustrated in FIG. 1A.

The volume control unit 122 can control the volume of the second sound. The HRTF/Volume control unit 124 can perform the HRTF on the first sound to move the first sound according to the detection result of the sound detection unit 110 and control the volume of the first sound before or after moving the first sound.

In another embodiment, the sound control unit 120 may include two HRTF/Volume control units 124*a* and 124*b*, as illustrated in FIG. 1B.

The HRTF/Volume control unit 124*a* can perform the HRTF on the first sound to move the first sound to a user's desired position according to the detection result of the sound detection unit 110 such that the user can clearly hear the second sound. Also, the HRTF/Volume control unit 124*a* can control the volume of the first sound before or after moving the first sound.

The HRTF/Volume control unit 124*b* can perform the HRTF on the second sound to is move the second sound to another user's desired position according to the detection result of the sound detection unit 110 such that the user can clearly hear the second sound. Also, the HRTF/volume control unit 124*a* can control the volume of the second sound before or after moving the second sound.

The mixer 130 mixes the first sound controlled by the sound control unit 120 and the second sound optionally controlled by the sound control unit 120.

FIG. 2 is a diagram for illustrating a process where the apparatus in FIG. 1 spatially separates first and second sounds.

Figure 2A:
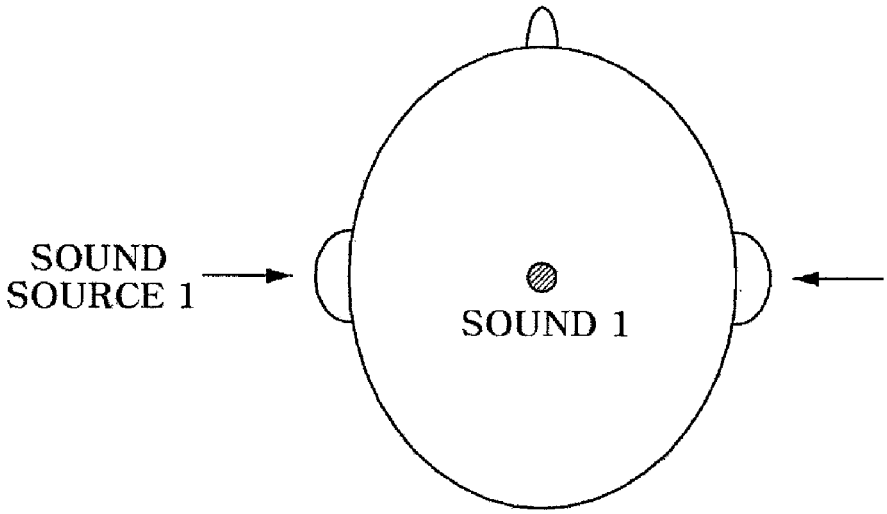
FIG. 2 is a diagram for illustrating a process where the apparatus in FIG. 1 spatially separates first and second sounds.

FIG. 2A illustrates a case in which a user hears a first sound outputted from a first sound source. For example, a first sound may be generated in the middle of the user's head.

Figure 2B:
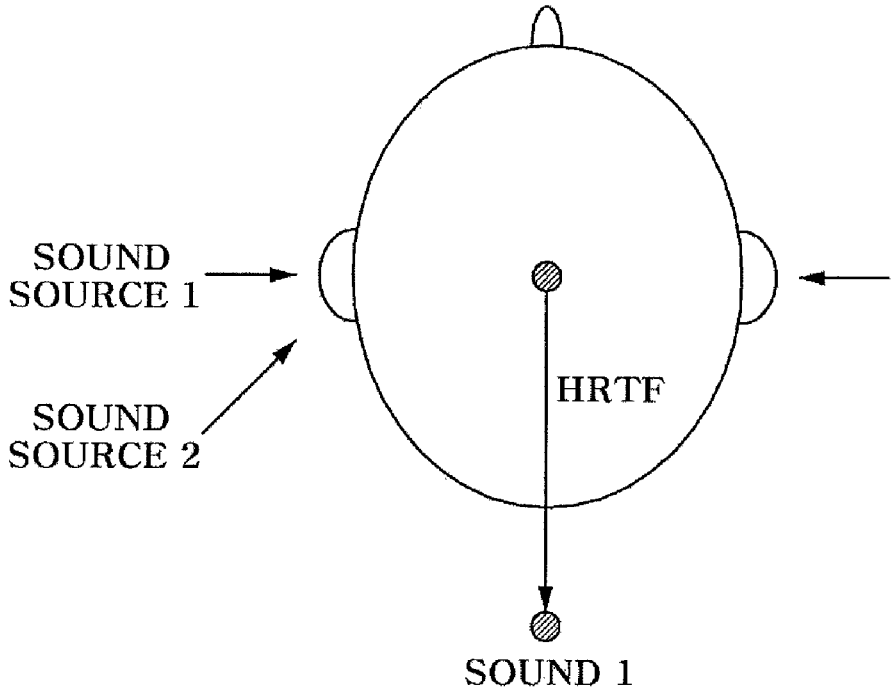

FIG. 2B illustrates a case in which the user hears a second sound while hearing the first sound. For example, the first sound may be moved behind the user's head.

Figure 2C:
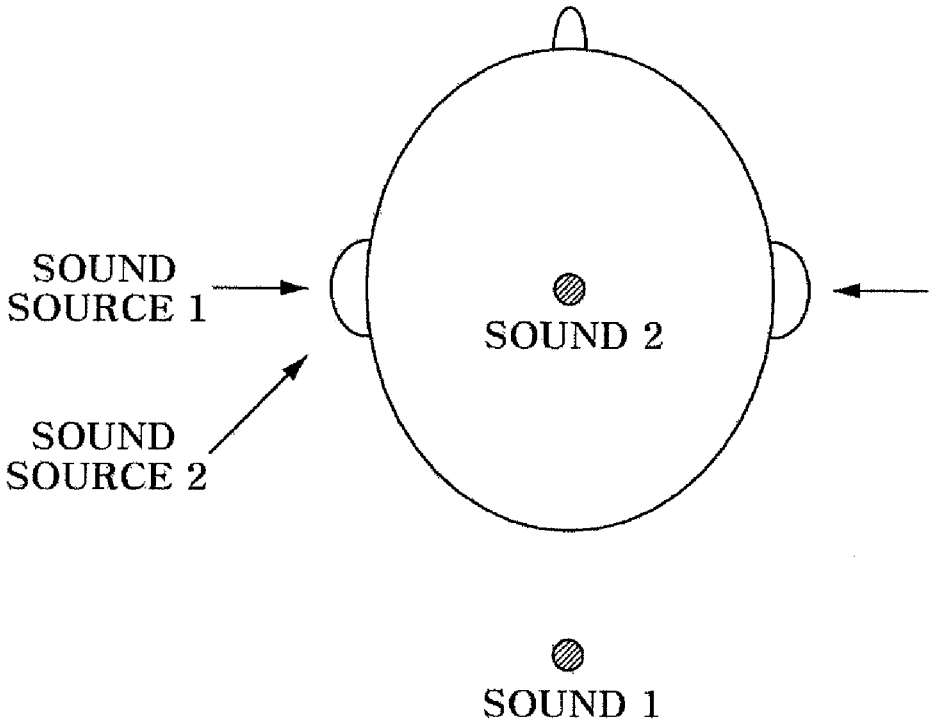

FIG. 2C illustrates a case in which the user hears the first and second sounds. For example, the first sound may be moved behind the user's head, and a second sound may be generated in the middle of the user's head.

Figure 3:
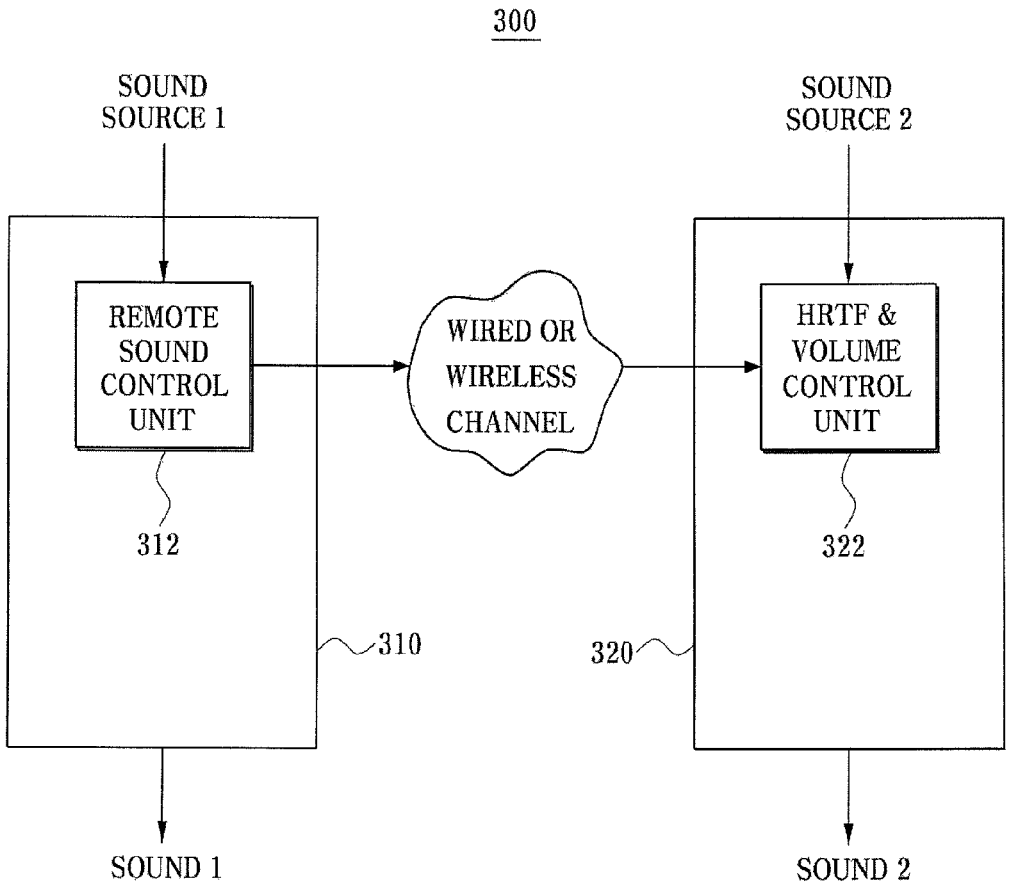
FIG. 3 is a block diagram illustrating a sound separating system according to another example embodiment of the described technology.

FIG. 3 is a block diagram illustrating a sound separating system according to another example embodiment of the described technology.

Referring to FIG. 3, a system 300 includes first and second apparatuses 310 and 320.

The first apparatus 310 includes a remote sound control unit 312 and generates a control signal when a first sound is output from a first sound source. For example, the first apparatus 310 may correspond to a telephone.

The second apparatus 320 includes an HRTF/Volume control unit 322. The second apparatus 320 can perform the HRTF on a second sound source based on the control signal generated from the first apparatus 310 to move the second sound outputted from the second sound source to a user's desired position. Also, the second apparatus 320 can control the volume of the second sound before or after moving the second sound. Consequently, the system 300 can spatially separate the first and second sounds and can set the first sound as a background sound.

In one embodiment, the user's desired position may be set by the user. In another embodiment, the user's desired position may be automatically set such that the second sound can be clearly heard. For example, the second apparatus 320 may correspond to an apparatus capable of outputting a sound such as an audio device or a television set.

The system of FIG. 3 is substantially the same as the apparatus in FIG. 1 except for the differences described above.

FIG. 4 is a diagram for illustrating a process where the system in FIG. 3 spatially separates first and second sounds.

Figure 4A:
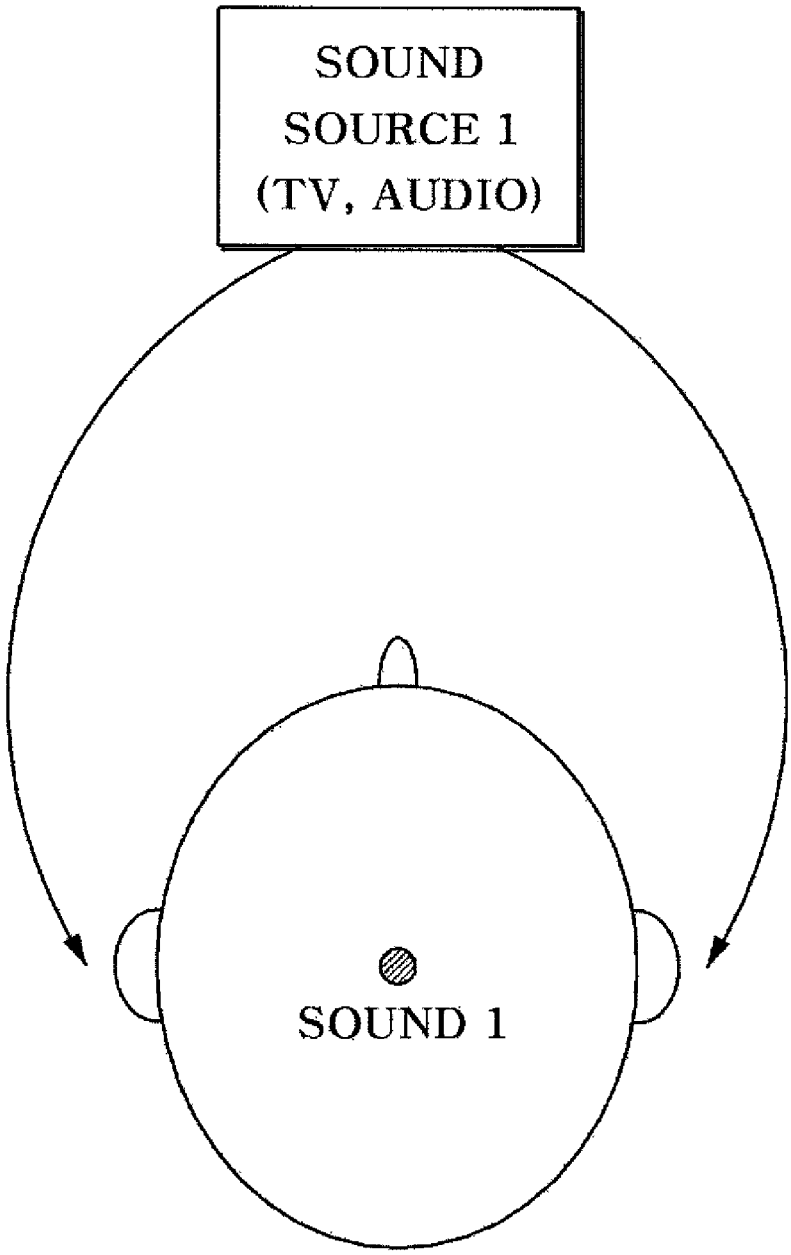
FIG. 4 is a diagram for illustrating a process where the system in FIG. 3 spatially separates first and second sounds.

FIG. 4A illustrates a case in which a user hears the first sound outputted from a first sound source. For example, a first sound may be generated in the middle of the user's head.

Figure 4B:
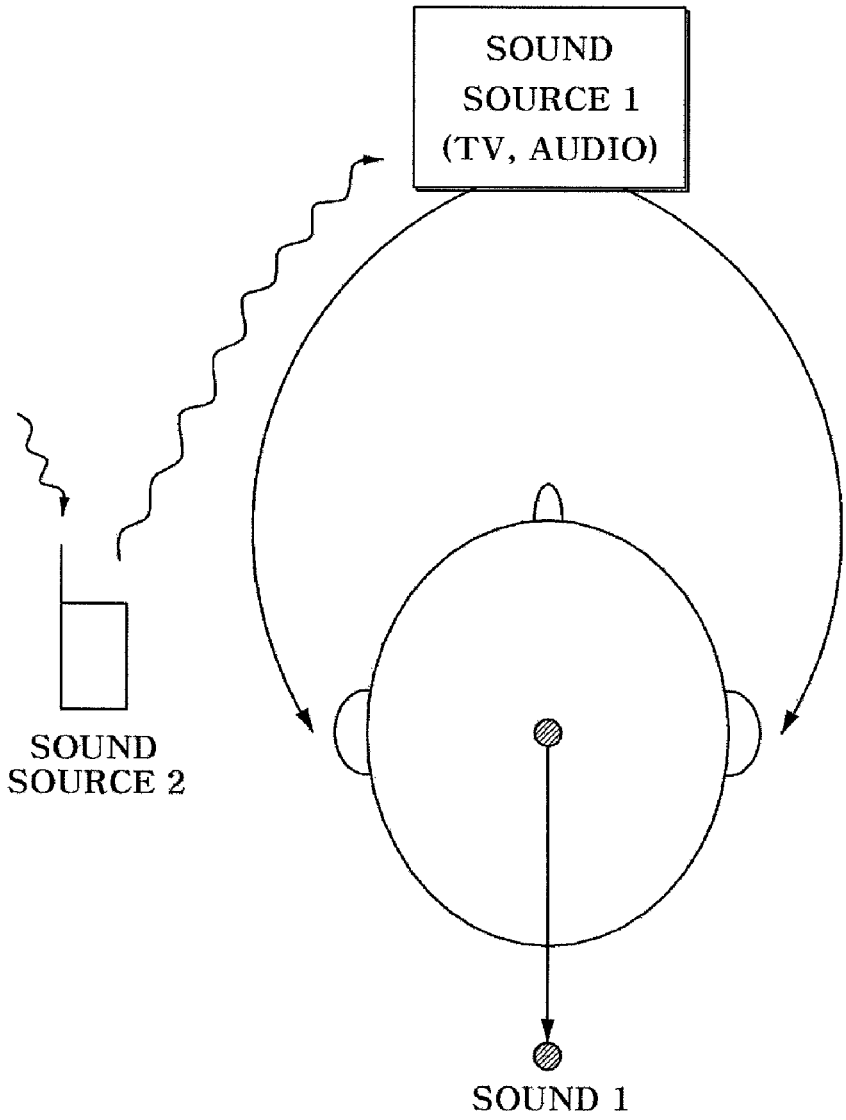

FIG. 4B illustrates a case in which the user hears the second sound while hearing the first sound. For example, the first sound may be moved behind the user's head.

Figure 4C:
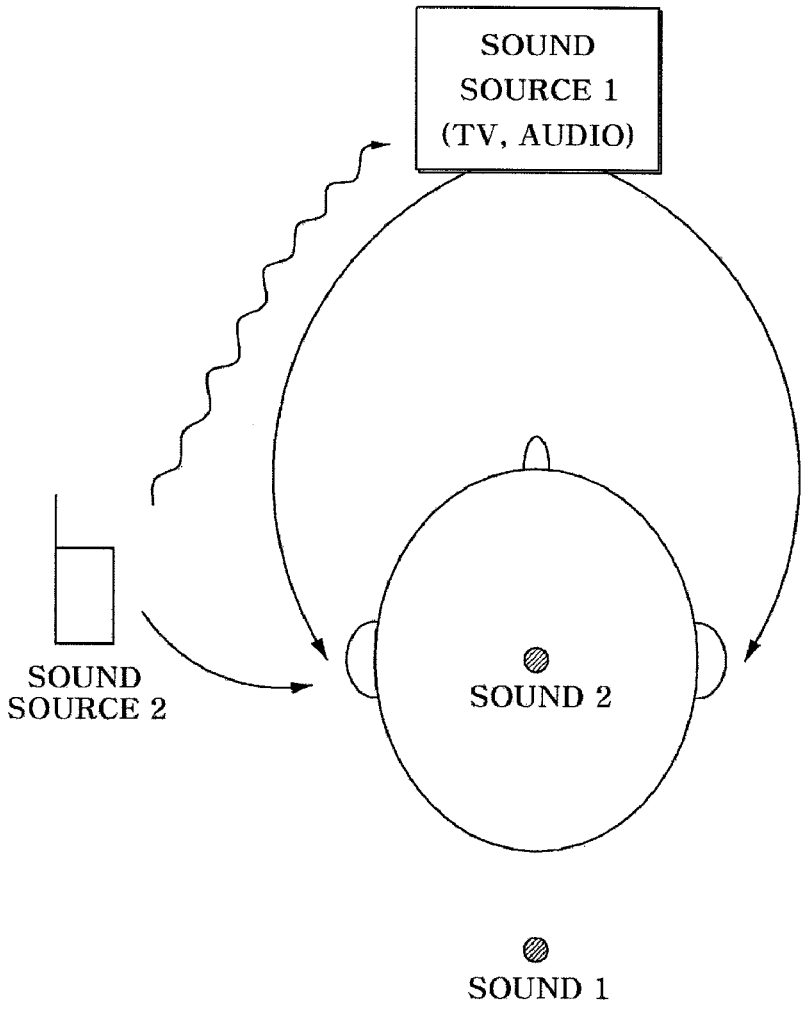

FIG. 4C illustrates a case in which the user hears the first and second sounds. For example, the second sound may be generated in the middle of the user's head.

Figure 5:
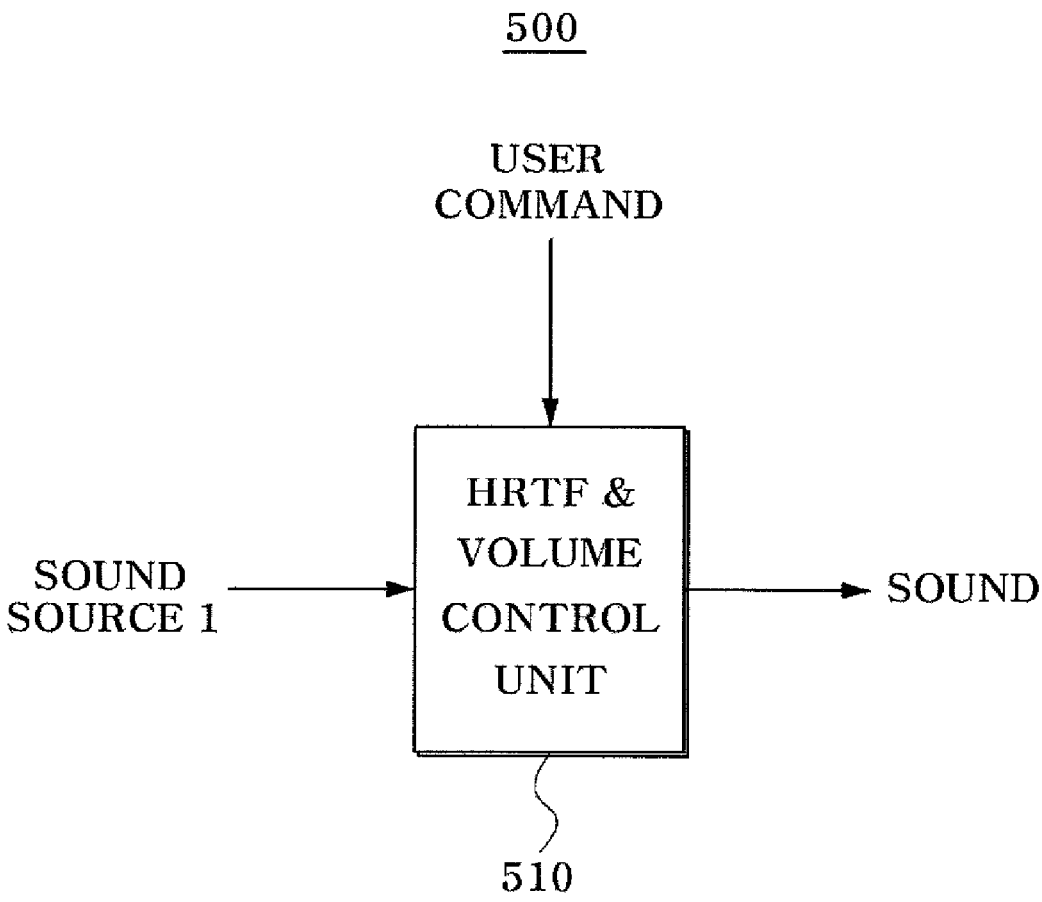
FIG. 5 is a block diagram illustrating an apparatus for setting a current sound as a background sound according to still another example embodiment of the described technology.

FIG. 5 is a block diagram illustrating an apparatus for setting a current sound as a background sound according to still another example embodiment of the described technology.

Referring to FIG. 5, an apparatus 500 includes an HRTF/Volume controller 510. When a user transfers a command while a first sound is output from a first sound source, the to apparatus 500 moves a first sound to a user's desired position by performing the HRTF on the first sound, and controls the volume of the first sound before or after moving the first sound. Thus, the apparatus 500 can set the first sound as a background sound.

For example, the apparatus 500 may be a music playing device. When the user wants to clearly hear a sound generated from the outside while listening to music, the user may transfer a user command to the apparatus 500.

In one embodiment, the user's desired position may be set by the user. In another embodiment, the user's desired position may be automatically set such that the sound generated from the outside can be clearly heard.

The above-described example embodiments may have effects including the following advantages. However, not all of the example embodiments necessarily include all the advantages, and some example embodiments may have additional advantages. Thus, the scope of the present invention is not limited by the described advantages.

A sound separating apparatus according to an example embodiment of the described technology can separate sounds outputted from at least two sound sources in space.

A sound separating apparatus according to an example embodiment of the described technology allows a user to simultaneously hear two or more sound sources.

A sound separating apparatus according to an example embodiment of the described technology allows a user to listen to one sound and simultaneously hear another sound as a background sound.

A sound separating apparatus according to an example embodiment of the described technology can set a current sound as a background sound.

It will be apparent to those skilled in the art that various modifications can be made to the above example embodiments without departing from the spirit and scope of the invention defined by the appended claims and their equivalents.

What is claimed is:

1. A cellular phone device configured to spatially separate sounds from at least two sound sources, wherein the apparatus comprises:

a sound detection unit configured to detect a first sound from a first sound source while a second sound is output from a second sound source;

a control signal generating unit configured to generate a control signal when the sound detection unit detects the first sound while the first sound is output from the first sound source and the second sound is output from the second sound source simultaneously; and a sound control unit configured to perform a head-related transfer function (HRTF) on the second sound base on the generated control signal to move the second sound to a user's desired position according to a detection of the first sound by the sound detection unit, while the first sound is output from the first sound source, so that the second sound is set as a background sound, wherein the first sound is a sound of an incoming call and the second sound is a sound of music played on the device.

2. The device of claim 1, wherein the sound control unit is configured to control a volume of the second sound at least one of before and after moving the second sound.

3. The device of claim 1, wherein the sound control unit is configured to perform another HRTF on the first sound to move the first sound to another desired position of the user so that the user can clearly hear the first sound.

4. The device of claim 3, wherein the sound control unit is configured to control a volume of the first sound at least one of before and after moving the first sound.

5. The device of claim 1, wherein the user's desired position is at least one of set by the user and automatically set such that the second sound can be clearly heard.

6. The device of claim 1, comprising a mixer configured to mix the moved first sound and the second sound.

* * * * *